United States Patent [19]

Sain

[11] Patent Number: 5,016,378

[45] Date of Patent: May 21, 1991

[54] FIREARM SAFETY APPARATUS

[76] Inventor: Kenneth D. Sain, 3200 Hodges, Amarillo, Tex. 79103

[21] Appl. No.: 529,534

[22] Filed: May 29, 1990

[51] Int. Cl.[5] ..... F41A 17/52

[52] U.S. Cl. ..... 42/70.06; 42/1.01; 42/97

[58] Field of Search ..... 42/1.01, 70.06, 71.01, 42/97, 101, 103

[56] References Cited

U.S. PATENT DOCUMENTS

| | | |
|---|---|---|
| 666,405 | 1/1901 | Baggett . |
| 937,396 | 10/1909 | Venier . |
| 1,432,254 | 10/1922 | Paterson et al. . |
| 2,134,406 | 10/1938 | Jacobs . |
| 3,044,204 | 7/1962 | Zimmerman . |
| 3,618,245 | 11/1971 | Pruonto . |
| 3,842,526 | 10/1974 | Dixon . |
| 4,007,553 | 2/1977 | Clegg . |
| 4,719,713 | 1/1988 | Hagle . |
| 4,739,569 | 4/1988 | Battle . |
| 4,829,692 | 5/1989 | Guild . |

*Primary Examiner*—Deborah L. Kyle
*Assistant Examiner*—Richard W. Wendtland
*Attorney, Agent, or Firm*—Leon Gilden

[57] ABSTRACT

An apparatus including an illumination member cooperative with a mechanical bolt, whereupon in a lowered position the apparatus effects blockage of an associated trigger of the firearm within the firearm mechanism while in a raised second position and effects electrical contact to further effect illumination of an indicator to provide visual indication of the firearm in a selective firing position. Alternatively, the mechanism may be oriented to effect illumination during the safety being in an engaged position with the associated trigger. Further modifications of the invention include a selective cover to overlie the illumination member, as well as a selective polarized lens support member to permit orientation of a variety of lenses into operative association with the illumination member to accommodate various light conditions in a shooting environment. Further, the battery supply mechanism for the instant invention may be movably mounted within the stock to effect selective balancing of the gun in use of the battery supply.

4 Claims, 5 Drawing Sheets

FIREARM SAFETY APPARATUS

BACKGROUND OF THE INVENTION

1. Field of the Invention

The field of invention relates to firearm safety devices, and more particularly pertains to a new and improved firearm safety apparatus wherein the same permits visual illumination during selective positions of a safety mechanism relative to an associated firearm.

2. Description of the Prior Art

Mechanical safety devices in cooperation with various firearms are frequently inconvenient during hunting conditions. Such mechanical devices are frequently awkward in permitting an operator of the firearm to appreciate whether a firearm safety device is in an engaged or disengaged position. The instant invention attempts to overcome deficiencies of the prior art by providing an illumination member in association with the firearm to effect illumination of the member upon the firearm being in a ready-to-fire condition. Prior art illumination members in association with a firearm may be found in U.S. Pat. No. 786,227 to Logan, et al. wherein a battery supply effects illumination of a site member in association with a firearm.

U.S. Pat. No. 2,134,406 to Jacobs provides a stock mounted battery cooperative with a switch to effect illumination of a bulb member in the gun stock when the safety mechanism is in a raised configuration.

U.S. Pat. No. 4,481,561 to Lanning utilized to boresite a long barreled shotgun or rifle to permit an enhanced pre-siting of a firearm prior to its use.

U.S. Pat. No. 2,912,566 to Cornett provides for a gun light selectively illuminated to enhance firing of the firearm in limited light conditions.

U.S. Pat. No. 3,245,071 to Pillsbury provides an illumination member mounted on a rifle to sign al other hunters of the presence of the signal to minimize accidental injury to hunters utilizing the device.

As such, it may be appreciated that there continues to be a need for a new and improved firearm safety apparatus wherein the same addresses both the problems of ease of use, as well as effectiveness in construction in providing visual illumination of a safety device preventing discharge of the firearm and this respect, the present invention substantially fulfills this need.

SUMMARY OF THE INVENTION

In view of the foregoing disadvantages inherent in the known types of firearm safety apparatus now present in the prior art, the present invention provides a firearm safety apparatus wherein the same utilizes a switch mechanism to visually illustrate and alert an individual as to a firing mode of a firearm apparatus. As such, the general purpose of the present invention, which will be described subsequently in greater detail, is to provide a new and improved firearm safety apparatus which has all the advantages of the prior art firearm safety apparatus and none of the disadvantages.

To attain this, the present invention provides an apparatus including an illumination member cooperative with a mechanical bolt, whereupon in a lowered position the apparatus effects blockage of an associated trigger of the firearm within the firearm mechanism while in a raised second position and effects electrical contact to further effect illumination of an indicator to provide visual indication of the firearm in a selective firing position. Alternatively, the mechanism may be oriented to effect illumination during the safety being in an engaged position with the associated trigger. Further modifications of the invention include a selective cover to overlie the illumination member, as well as a selective polarized lens support member to permit orientation of a variety of lenses into operative association with the illumination member to accommodate various light conditions in a shooting environment. Further, the battery supply mechanism for the instant invention may be movably mounted within the stock to effect selective balancing of the gun in use of the battery supply.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will from the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved firearm safety apparatus which has all the advantages of the prior art firearm safety apparatus and none of the disadvantages.

It is another object of the present invention to provide a new and improved firearm safety apparatus which may be easily and efficiently manufactured and marketed.

It is a further object of the present invention to provide a new and improved firearm safety apparatus which is of a durable and reliable construction.

An even further object of the present invention is to provide a new and improved firearm safety apparatus which is susceptible of a low cost of manufacture with regard to both materials and labor, and which accordingly is then susceptible of low prices of sale to the consuming public, thereby making such firearm safety apparatus economically available to the buying public.

Still yet another object of the present invention is to provide a new and improved firearm safety apparatus which provides in the apparatuses and methods of the prior art some of the advantages thereof, while simultaneously overcoming some of the disadvantages normally associated therewith.

Still another object of the present invention is to provide a new and improved firearm safety apparatus wherein the same utilizes a member that is illuminated in response to a safety mechanism being disengaged from associated trigger of a firearm to visually apprise an individual as to the readiness of a firearm in a shooting scenario.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
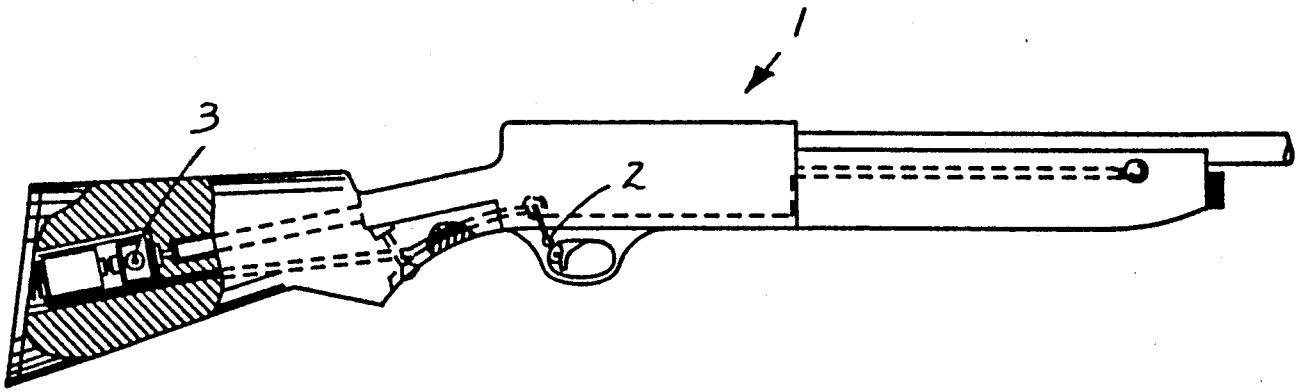
FIG. 1 PRIOR ART
FIG. 1 is an orthographic side view of a prior art firearm safety apparatus.
Figure 2:
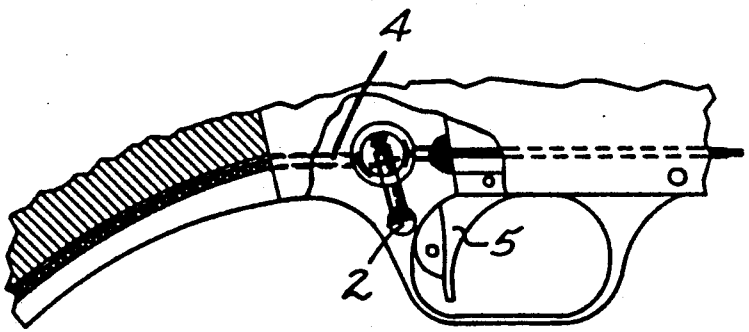
FIG. 2 PRIOR ART
FIG. 2 is an orthographic side view, somewhat enlarged, of the firearm safety apparatus as set forth in FIG. 1.
Figure 3:
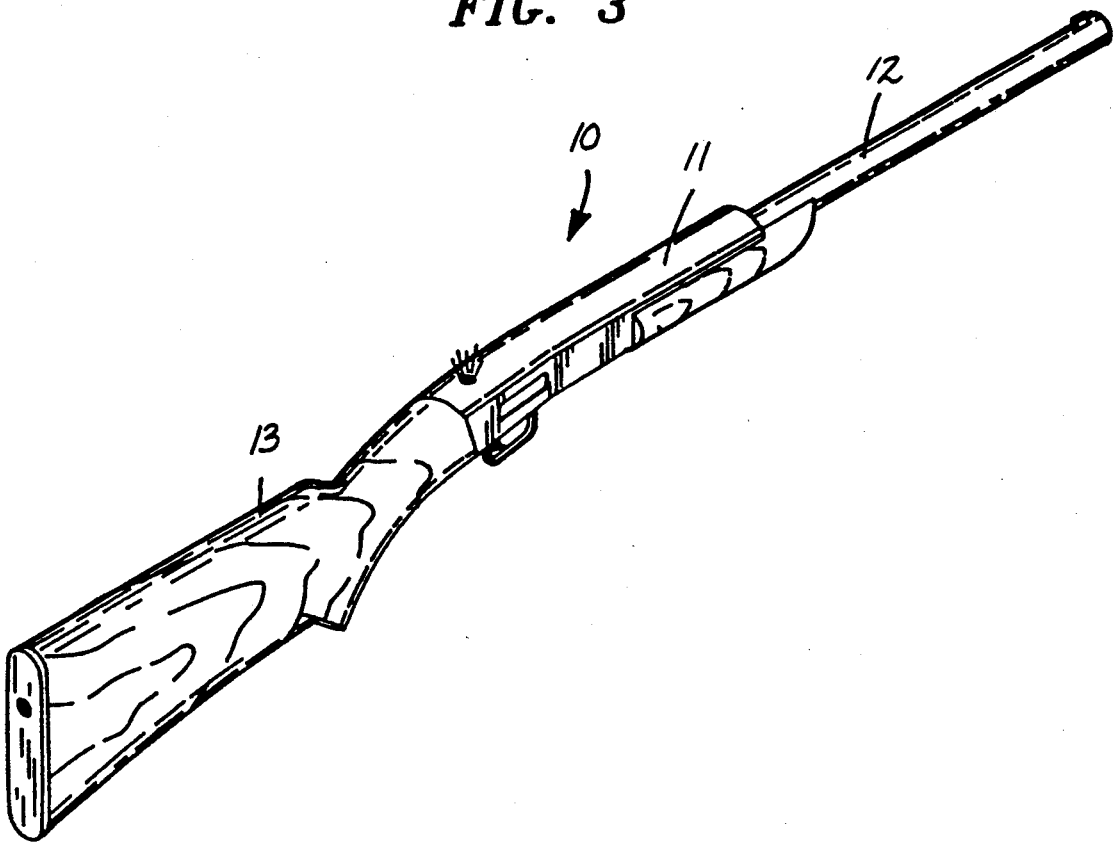
FIG. 3 is an isometric illustration of the instant invention in association with a conventional firearm.

With reference now to the drawings, and in particular to FIGS. 1 to 10 thereof, a new and improved firearm safety apparatus embodying the principles and concepts of the present invention and generally designated by the reference numeral 10 will be described.

FIG. 1 illustrates a prior art firearm safety apparatus 1, wherein a safety bolt 2 cooperates with an illumination member 3 mounted in the stock to effect illumination of the member 3 when the bolt 2 is in a raised position. The bolt 2 is in operative association with the trigger 5 to direct current through the wires 4 containing a circuit for illumination of the illumination member 3.

Figure 4:
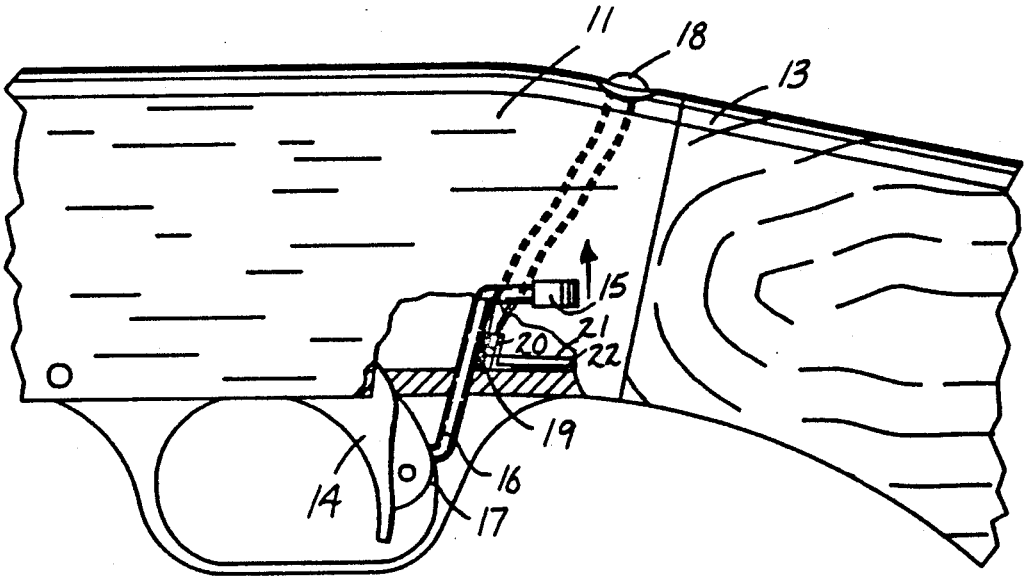
FIG. 4 is an orthographic side view, partially in section, of the instant invention in association with a firearm.
Figure 5:
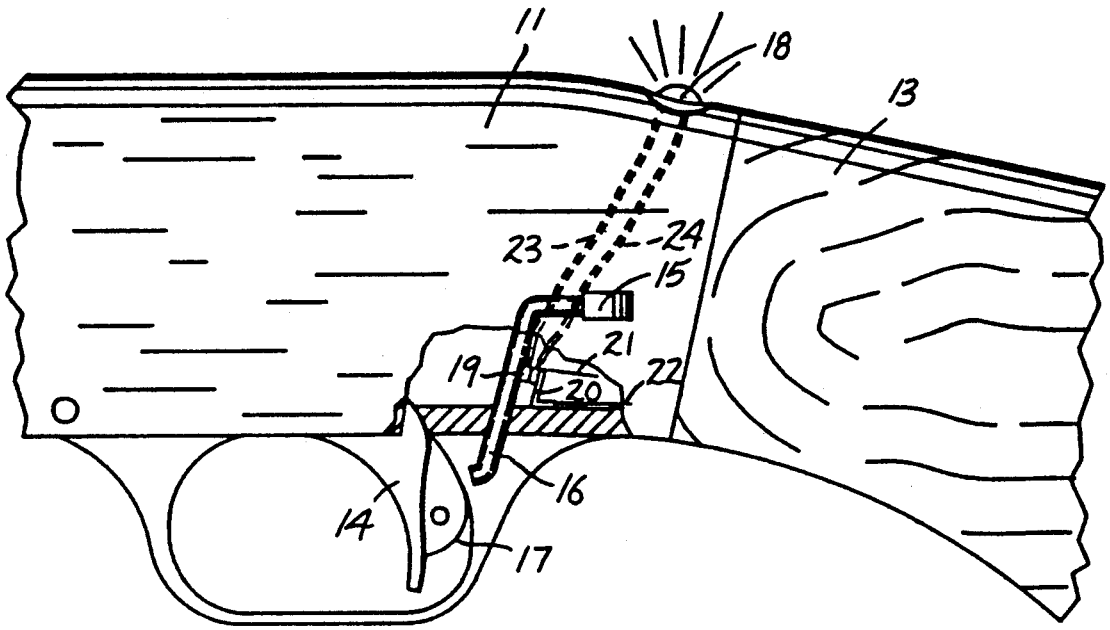
FIG. 5 is an orthographic side view, partially in section, of the instant invention in a disengaged position relative to the associated firearm.
Figure 6:
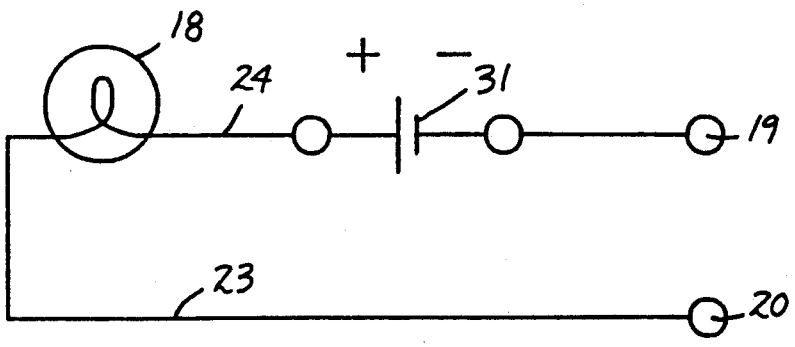
FIG. 6 is a diagrammatic illustration of the circuitry available for use by the instant invention.

More specifically, the firearm safety apparatus 10 of the instant invention essentially comprises a firearm mechanism 11 cooperative with a firearm barrel 12 extending forwardly thereof, and a firearm stock 13 directed rearwardly thereof. A trigger 14 within a trigger housing effects firing of the mechanism 11 in a conventional manner. A slidably mounted safety bolt 15 includes a head portion projecting exteriorly of the firearm mechanism 11, with an "S" shaped safety leg 16 positioned interiorly of the firearm mechanism 11, with a lower terminal end of the "S" shaped safety leg 16 oriented rearwardly of the trigger 14 and more specifically of a rear surface 17 of the trigger 14. In a lowered first position, the lower terminal end of the "S" shaped safety leg 16 abuts the rear surface 17 to prevent firing of the mechanism 11 and prevents rearward pivotment of the trigger 14, as illustrated in FIG. 4. When the safety bolt 15 is in a raised second position, the lower terminal end of the "S" shaped safety leg 16 is removed and spaced from the rear surface 17 to permit pivotment of the trigger 14 and associated firing of the firing mechanism 11.

When the safety bolt 15 is in a lowered position, a first sliding contact 19 mounted to the "S" shaped safety leg 16 is spaced from a second fixed contact that in turn is mounted interiorly and fixedly within the firearm mechanism 11. In the raised second position, the first and second contacts 19 and 20 respectively are in electrical communication with one another and provide electrical communication with a battery 31 (see FIGS. 6, 9, and 10 for example) to direct electrical current through respect first and second battery wires 21 and 22 through associated first and second contact wires 23 and 24 associated with the respective first and second contacts 19 and 20 to effect illumination of an illumination member 18 mounted in the firearm mechanism adjacent an interface between the firearm mechanism 11 and the stock 13 on a top surface of the firearm mechanism to provide visual illumination of the operative firing condition of the associated firearm.

Figure 7:
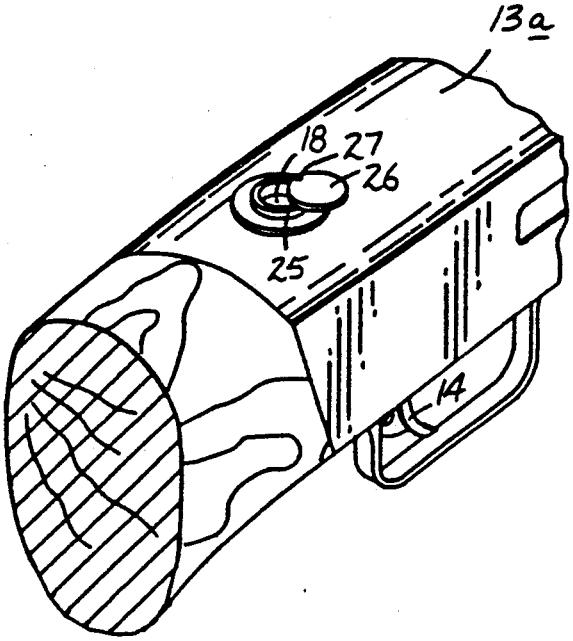
FIG. 7 is an isometric illustration of the illumination member, including a covering cap.
Figure 8:
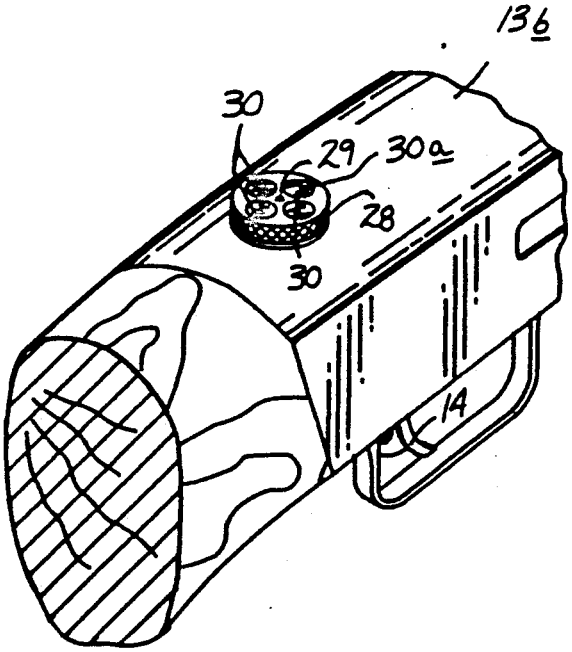
FIG. 8 is an isometric illustration of the illumination member in cooperation with a rotatable drum assembly housing a plurality of various lenses.

FIG. 7 illustrates the use of a shield 26 pivotally overlying a cylindrical cup member 25, with the illumination member 18 recessed within the cup member 25, and a shield axle 27 mounted to the cup member 25 to permit selective covering of the illumination member 18 to enable an operator of the firearm to cover the illumination member 18 and avoid distraction subsequent to acknowledgment that the firearm is in a condition ready to discharge a projectile. Further, FIG. 8 illustrates a further illumination modification type device, wherein a rotatably mounted drum assembly 28 includes a drum assembly axle 29 to permit rotation of the drum assembly 28. The drum assembly 28 includes a series of lenses, including three polarized lenses 30 of various shadings to selectively enhance visual observation of the illumination member 18 during conditions of excessive light, such as during a mid-day sunlit environment, with successfully darkened lenses of the plurality of polarized lenses to shade the illumination member during dim lit conditions to minimize distraction of the illumination member, with a fourth opaque shield **30*a*** to overlie the illumination member and completely mask the illumination member to avoid distraction of the an operation of the firearm.

Figure 9:
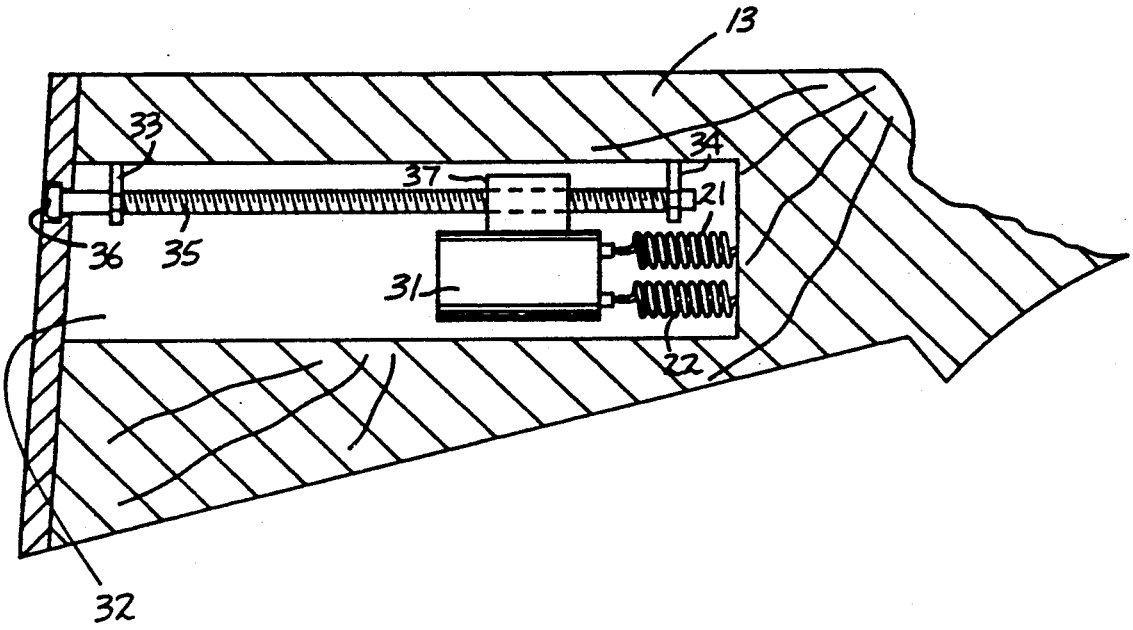
FIG. 9 is an orthographic cross-sectional view of the firearm stock of the instant invention.
Figure 10:
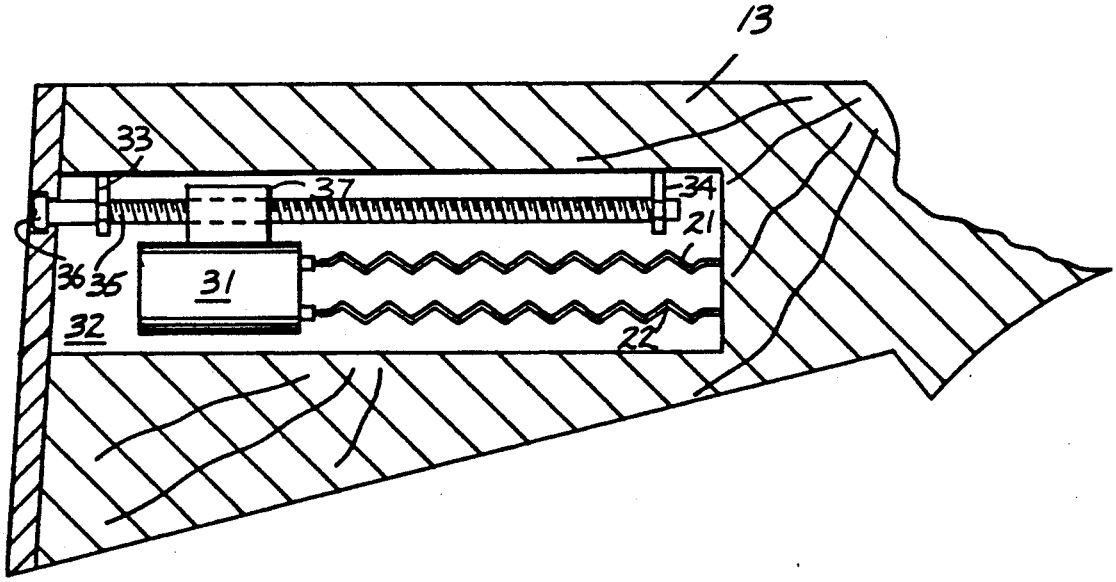
FIG. 10 is an orthographic side view, partially in section, of the firearm stock of the instant invention in a adjusted position of the battery pack utilized therewith.

FIG. 9 illustrates a mounting of the battery pack 31 within the firearm stock 13, whereupon the battery 31 utilizes the first and second battery wires 22 and 23 to operably associate the battery 31 with the first and second contacts. The battery pack 31 includes an internally threaded battery support saddle 37 that threadedly receives an elongate threaded and rotatable boss 35 therethrough. The threaded boss 35 is mounted within a rear and forward hanger 33 and 34 respectively that permits rotation and positioning of the threaded boss 35 therewithin. An exposed rotatable boss head 36 projects rearwardly from the stock cavity 32 exteriorly of the stock to permit an individual to rotate the boss head 36, thereby effecting rotation of the threaded boss 35 and permit repositioning of the battery pack 31 to allow an individual to balance the firearm mechanism as desired, dependent upon whether a siting scope is utilized or not and thereby permit the individual to balance the rifle assembly as desired. It is of course noted that the threaded boss 35 is captured within the rear and forward hangers 33 and 34, wherein the rear and forward hangers 33 and 34 respectively secure and position the threaded boss 35 within the stock cavity 32. The stock cavity 32 is longitudinally aligned to permit orientation of the battery pack 31, as required for effecting balancing of the firearm.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A firearm safety apparatus comprising, in combination, a firearm mechanism, including a housing, and a firearm stock extending rearwardly of the housing, and a trigger pivotally mounted underlying the housing to effect actuation of the firearm mechanism, and a slidably mounted safety bolt directed through the housing, including an "S" shaped safety leg, wherein the "S" shaped safety leg includes a lower terminal end, and the trigger includes a rear surface, and the lower terminal end of the "S" shaped safety leg arranged for selective abutment with the rear surface of the trigger, and the lower terminal end of the "S" shaped safety leg in abutment with the rear surface of the trigger in a first lowered position, and the "S" shaped safety leg spaced from the rear surface of the trigger in an extended second position, and a first electrical contact mounted to the "S" shaped safety leg, and a second contact mounted within the housing, wherein the first and second contacts are spaced apart in the first position and in electrical communication in the second position, and a battery and an illumination member, wherein the battery, illumination member, and first and second contacts are in electrical association relative to one another, and the illumination member mounted extending through the housing for visual observation, wherein the first and second contacts in the second position effect illumination of the illumination member, and wherein the illumination member includes a shading member mounted over the illumination member to effect selective shading of the illumination member.

2. An apparatus as set forth in claim 1 wherein the shading member includes a rotatably drum assembly, the rotatably drum assembly including a plurality of contrastingly shaded lenses, each of the lenses selectively positionable overlying the illumination member.

3. An apparatus as set forth in claim 2 wherein one of the lenses is opaque, and the lenses include polarized lenses.

4. An apparatus as set forth in claim 3 wherein the stock includes an elongated longitudinally aligned cavity, the cavity including a forward hanger and a rear hanger, with a threaded rotatably boss mounted to the forward and rear hanger, the threaded boss including a rotatably boss head extending rearwardly and directed through the stock, and the battery including a battery mount, the battery mount including an internally threaded support saddle, the internally threaded support saddle threadedly receiving the threaded rotatably boss therethrough, wherein rotation of the boss head effects reciprocation of the battery and battery housing within the cavity.

* * * * *